US008040284B2

(12) United States Patent
Teng et al.

(10) Patent No.: US 8,040,284 B2
(45) Date of Patent: Oct. 18, 2011

(54) HANDSET DEVICE

(75) Inventors: Pei-Ling Teng, Taoyuan County (TW); Yi-Chun Chen, Taoyuan County (TW)

(73) Assignee: HTC Corporation, Taoyuan County (TW)

( * ) Notice: Subject to any disclaimer, the term of this patent is extended or adjusted under 35 U.S.C. 154(b) by 323 days.

(21) Appl. No.: 12/371,633

(22) Filed: Feb. 16, 2009

(65) Prior Publication Data

US 2010/0052998 A1 Mar. 4, 2010

(30) Foreign Application Priority Data

Sep. 3, 2008 (TW) ..... 97133801 A

(51) Int. Cl.
*H01Q 1/24* (2006.01)
*H01Q 1/48* (2006.01)

(52) U.S. Cl. ..... 343/702; 343/700 MS; 343/846

(58) Field of Classification Search ..... 343/700 MS, 343/702, 846; 455/90.1, 575.7
See application file for complete search history.

(56) References Cited

U.S. PATENT DOCUMENTS 7,151,955 B2 * 12/2006 Huber et al. ..... 455/575.5
2008/0252536 A1 * 10/2008 Anguera et al. ..... 343/702

FOREIGN PATENT DOCUMENTS

| | | |
|---|---|---|
| EP | 1796207 | 6/2007 |
| WO | 99-54956 | 10/1999 |
| WO | 02-19671 | 3/2002 |
| WO | 03-067702 | 8/2003 |
| WO | 2007-039071 | 4/2007 |

OTHER PUBLICATIONS

"Search report of Europe counterpart application", issued on Jun. 3, 2009, p. 1-p. 7.

* cited by examiner

*Primary Examiner* — Hoang V Nguyen
(74) *Attorney, Agent, or Firm* — Jianq Chyun IP Office

(57) ABSTRACT

A handset device including a ground plane, an antenna, a first conductive strip and a second conductive strip is provided. The antenna is electrically connected to the ground plane and forms a current loop with the ground plane. The ground plane forms a current area according to the current loop. The first conductive strip is electrically connected to the current area and changes a current distribution on the ground plane to increase a current density passing through the current area.

12 Claims, 5 Drawing Sheets

HANDSET DEVICE

CROSS-REFERENCE TO RELATED APPLICATION

This application claims the priority benefit of Taiwan application serial no. 97133801, filed on Sep. 3, 2008. The entirety of the above-mentioned patent application is hereby incorporated by reference herein and made a part of specification.

BACKGROUND OF THE INVENTION

1. Field of the Invention

The application relates to a handset device, particularly a handset device that uses a conductive strip to change a current distribution on a ground plane of a system.

2. Description of Related Art

Currently, telecommunications of the public have entered the age of wireless communications, so handset devices are used more and more often in different sorts of occasions and are more and more diverse, such as cell phones, smart phones, multimedia players, personal digital assistants, satellite positioning devices, and so on. Different sorts of small-sized handset devices have been gradually developed and have become necessary electronic products in the daily lives of people.

During the development of wireless communications, the Federal Communications Commission (FCC) further presented rules of Hearing Aid Compatibility (HAC) to define the compatibility and safety between the hearing aids and many kinds of communication equipment. Under rules of HAC, cell phone manufacturers are obligated to limit the electromagnetic interference (EMI) of cell phones below a threshold, wherein the EMI includes electric fields and magnetic fields interfering with and affecting the endurance of hearing aids. Normal HAC does not just seek to solve the effects of electric fields on hearing aids; interferences by magnetic fields are not negligible either. It orders that the M3 Rating must be achieved. That is to say, the electric field value is less than 84.1 V/m and the magnetic field value is less that 0.25 A/m. In addition, cell phone manufacturers further provided some cell phones that comply with the rules of HAC, so that audio frequency signals are transmitted to hearing aids using electromagnetic induction functions of telecoils.

With respect to the realization of cell phones complying with rules of HAC, present technologies mostly increase distances between antennas and receivers, so that the limitation of EMI regulated by the rules of HAC is complied with. Increases in the distances between the antennas and the receivers must be realized by changing the positions where the antennas are disposed. However, present technologies mostly can only change the positions of the antennas by using external antennas, as provided in U.S. Pat. No. 7,342,545 B2, for example. Thereby, not only the exterior design of cell phones is restricted, but also development towards miniaturization and applications of cell phones is affected.

SUMMARY OF THE INVENTION

The application is directed to a handset device which not only complies with rules of HAC, but also gives consideration to development towards miniaturization and applications.

The application provides a handset device, comprising a ground plane, an antenna, a first conductive strip and a second conductive strip. The antenna is electrically connected to the ground plane, and forms a current loop with the ground plane.

In addition, the ground plane forms a current area according to the current loop. On the other hand, the first conductive strip is electrically connected to the current area. The second conductive strip is coupled to the ground plane and the first conductive strip. Thereby, the handset device changes a current distribution on the ground plane through the first and the second conductive strips to increase a current density passing through the current area.

According to an embodiment of the application, the handset device further comprises an absorbing strip electrically connected to the ground plane. The absorbing strip is an absorbing material with high permeability to control a change in a magnetic field formed by an increase in the current density in the current area.

In an embodiment of the application, the ground plane comprises a first side and a second side opposite to each other. In addition, the antenna is disposed along the first side. Furthermore, the first conductive strip and the second conductive strip are disposed on the second side, and the length of the first conductive strip is not longer than the length of the second side. A ground conductor is disposed on the second side and is electrically connected to the ground plane.

According to an embodiment of the application, the antenna comprises a radiating part, a feeding part and a short circuit part. The radiating part of the antenna is disposed along the first side of the ground plane and parallel to the ground plane; the feeding part is electrically connected to the radiating part and the ground plane. In addition, the ground plane further comprises a third side. The third side is adjacent to the first side, and the short circuit part of the antenna is electrically connected to the third side of the ground plane, wherein the short circuit part is also electrically connected to the radiating part.

The application uses the first conductive strip and the second conductive strip to change the current distribution on the ground plane, and uses the absorbing strip to inhibit a transmission of the magnetic field. Therefore, in a situation of disposing the antenna, the handset device of the application lowers the influence of an electric field and the magnetic field on a hearing aid when they are near a receiver, so that rules of HAC are complied with. In other words, the application not only realizes simultaneous operation of the handset device and the hearing aid, but also gives consideration to development towards miniaturization and applications.

In order to make the aforementioned and other features and advantages of the application more comprehensible, several embodiments accompanied with figures are described in detail below.

BRIEF DESCRIPTION OF THE DRAWINGS

The accompanying drawings constituting a part of this specification are incorporated herein to provide a further understanding of the invention. Here, the drawings illustrate embodiments of the invention and, together with the description, serve to explain the principles of the invention.

DESCRIPTION OF EMBODIMENTS

Figure 1:
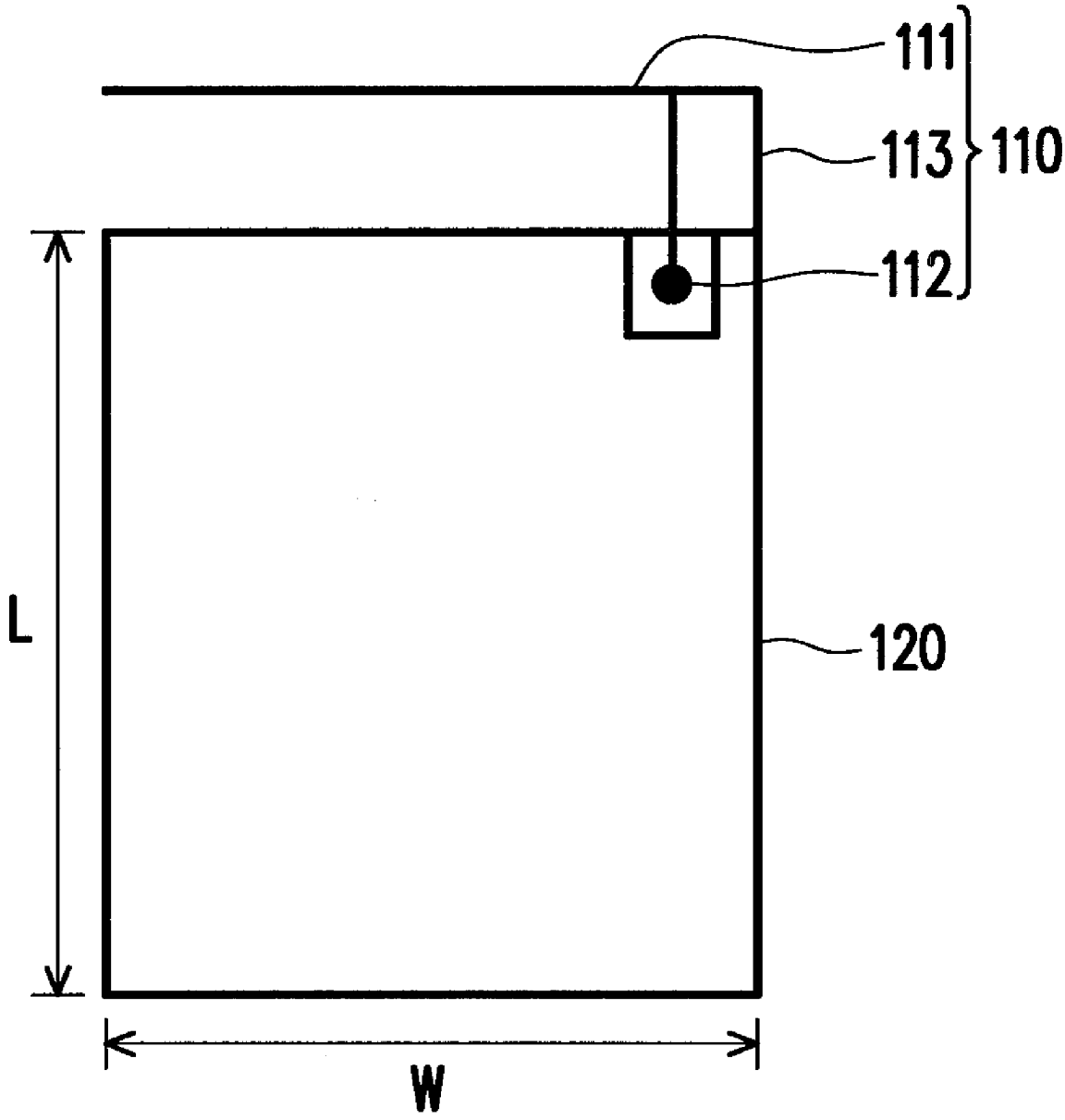
FIG. 1 is a schematic view showing an antenna and a ground plane.

Before illustrating the embodiments of the application, relationships between a ground plane of the system and radiating properties of an antenna must be clarified. FIG. 1 is a schematic view showing an antenna and a ground plane, wherein the antenna is marked as 110 and the ground plane is marked as 120. Referring to FIG. 1, if the antenna 110 is assumed as an electronic component, it at least comprises a radiating part 111, a feeding part 112 and a short circuit part 113. Here, the radiating part 111 is used to receive or send signals, the feeding part 112 is used to feed signals, and the short circuit part 113 must be connected to the ground plane 120. The radiating part 111, the feeding part 112 and the short circuit part 113 are electrically connected to one another.

In general, the antenna 110 forms a complete current loop with the ground plane 120 and in a stable condition. The ground plane 120 forms a current area according to the current loop. For example, the current area includes a low current area and a high current area. At this moment, the antenna 110 has the best radiating efficiency. In addition, there is a current distribution on the ground plane 120, and radiating properties of the antenna 110 also change due to variations of the current distribution on the ground plane 120.

Figure 2:
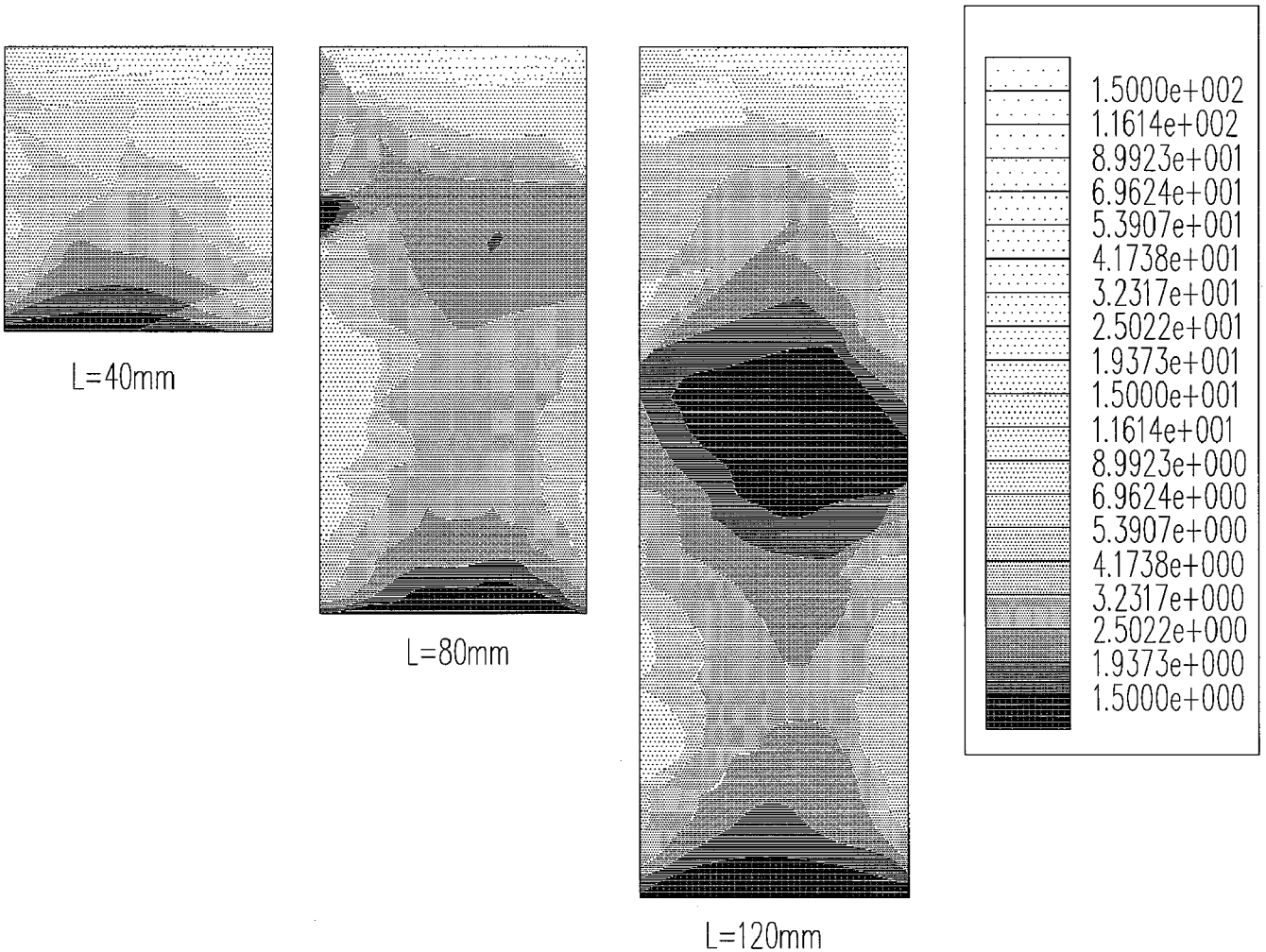
FIG. 2 is a simulation view showing current distributions when an antenna 110 is connected to ground planes 120 with different lengths.

For example, FIG. 2 is a simulation view showing the current distributions when the antenna 110 is connected to the ground planes 120 with different lengths, wherein L signifies the lengths of the ground planes. Referring to FIG. 2, it is proved that the ground plane 120 is one of the main parameters affecting distributions of various sorts of energy, for example, currents, electric fields, magnetic fields, radiating effects. When the length L of the ground plane 120 is approximately the resonant wavelength of the antenna 110, the antenna 110 is viewed as a symmetrical antenna structure (a dipole antenna), and the current distribution of the ground plane 120 is uniform.

Oppositely, when the length L of the ground plane 120 is longer than the resonant wavelength of the antenna 110, the antenna 110 is viewed as an asymmetrical antenna structure, so that the current distribution of the ground plane 120 is affected and performance of a radiating pattern is indirectly affected. By using a vector magnetic potential of a wave equation to analyze the relationship of the radiating pattern, it is known that a direction in which a current density decreases is a direction in which an electric field increases.

More importantly, since an electric field value at a position of a receiver is the main factor determining HAC, in the technical measurements of the application, current densities around the receiver and the ground plane of the system are changed to lower the electric field value, and the direction in which the current density decreases is the direction in which the electric field increases. For example, the antenna structure of the handset device is designed on a far side of the receiver, and an extended grounding strip in the receiver end is used to change a distribution of a current null point; therefore a current density near the receiver end is increased, and a current density around an area of the antenna is decreased at the same time, so that the electric field value of the receiver is decreased to comply with the rules of HAC by the FCC.

Furthermore, a floating metal sheet is attached to a housing of the handset device, with an appropriate distance away from the ground plane of the system at the receiver end. By using a capacitance effect generated by the metal sheet and the system ground plane, the current distribution on the ground plane is changed at the same time when charges are accumulated, so that a current in a specific area near the receiver end is increased, achieving an effect of lowering the electric field.

However, when lowering the electric field using the above method, a magnetic field value of the receiver end is correspondingly increased slightly due to the increase in the current density. The magnetic field value must also comply with rules of the FCC, so the application adds an absorber with high permeability at specific places, such as a substrate, in the handset device to control a distribution of the magnetic field, and to restrain transmission of the magnetic field at the same time. The following uses the above concepts to illustrate the embodiments of the application.

Figure 3:
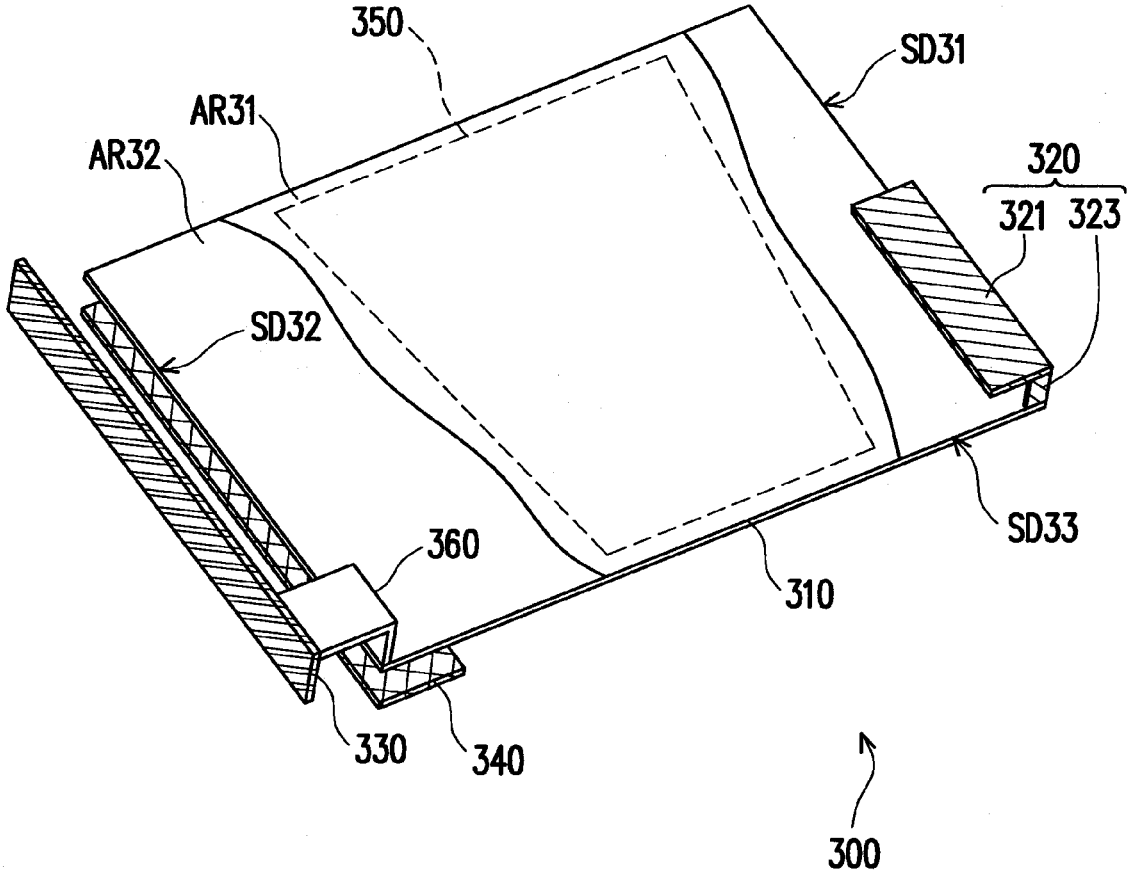
FIG. 3 is a schematic view showing a part of components of the handset device according to an embodiment of the present invention.
Figure 4:
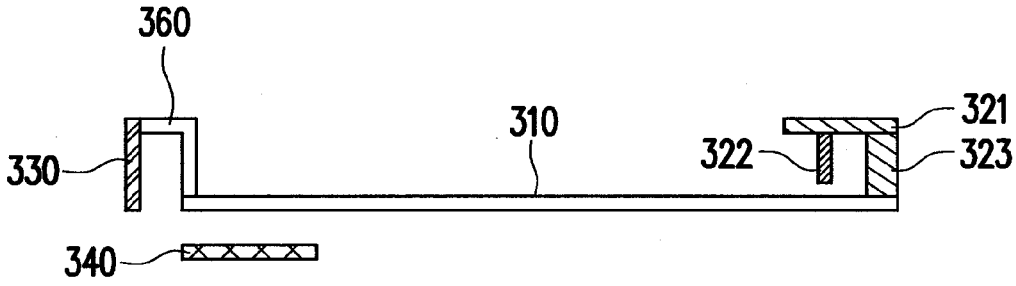
FIG. 4 is a side view showing the handset device in FIG. 3.

FIG. 3 is a schematic view showing part of components of the handset device according to an embodiment of the present invention. FIG. 4 is a side view showing the handset device in FIG. 3. Referring to FIG. 3, the handset device comprises a ground plane 310, an antenna 320, a first conductive strip 330, a second conductive strip 340, an absorbing strip 350 and a ground conductor 360. The ground plane 310 comprises a first side SD31 and a second side SD32 opposite to each other, and a third side SD33. In addition, the handset device 300 is, for example, a personal digital assistant phone, a smart phone, a satellite positioning device or a personal digital assistant.

In general operation, the antenna 320 is electrically connected to the ground plane 310, and forms a complete current loop with the ground plane 310 in a stable condition. Therefore, the handset device 300 can use the antenna 320 to receive and send signals. Relatively, there is a corresponding current distribution on the ground plane 310 according to the current loop, so that at least one high current area AR31 and at least one low current area AR32 are formed.

According to the present embodiment, since the antenna 320 is disposed along the first side SD31 of the ground plane 310 and electrically connected to the third side SD33 adjacent to the first side SD31, the ground plane 310 generates a corresponding current distribution. The low current area AR32 is distributed around the second side. SD32 of the ground plane 310, and the high current area AR31 is distributed in middle of the ground plane 310.

It should be noted that, a person of ordinary skill in the related art may arbitrarily change the disposed position of the antenna 320 according to design requirement. In addition, the current distribution on the ground plane changes along with a length of the ground plane 310 and a disposed position of the antenna 320. Therefore, relative disposed positions of the antenna 320 and the ground plane 310, and the distributions of the low current area AR32 and the high current area AR31, according to the present embodiment, are not used to limit the application.

Continue referring to FIG. 3, the antenna 320 comprises a radiating part 321, a feeding part 322 and a short circuit part 323. The radiating part 321 is disposed along the first side SD31 of the ground plane 310 and parallel to the ground plane 310. In addition, the short circuit part 323 is electrically connected to the third side SD33 of the ground plane 310. On the other hand, the ground conductor 360 is disposed on the second side SD32 of the ground plane 310 to be electrically connected to the ground plane 310.

The first conductive strip 330 is disposed parallel to the second side SD32 of the ground plane 310, and is electrically connected to the low current area AR32 of the ground plane 310 through the ground conductor 360. A length of the first conductive strip 330 is not longer than a length of the second side SD32 of the ground plane 310. Furthermore, the second conductive strip 340 is coupled to the ground plane 310 and the first conductive strip 330. In practice, a disposed position of the second conductive strip 340 is substantially parallel to the low current area AR32 of the ground plane 310.

When the first conductive strip 330 and the second conductive strip 340 are not yet disposed in the handset device, the current on the ground plane 310 is mainly focused near the antenna 320, which is the high current area AR31. This means that at this moment, the radiating pattern is mainly oriented towards the ground plane 310; as mentioned before, a direction in which a current density decreases is a direction in which an electric field increases.

To alleviate the above situation, the present embodiment uses the first conductive strip 330 and the second conductive strip 340 to change the current distribution on the ground plane 310. In the present embodiment, the first conductive strip 330 is used to change a distribution of a current null point of the ground plane 310. In addition, a capacitance effect generated by the second conductive strip 340 and the ground plane 310 changes the current distribution on the ground plane 310 at the same time when charges are accumulated.

Therefore, when the first conductive strip 330 and the second conductive strip 340 are disposed in the handset device 320, a current flowing through the low current area AR32 increases relatively, so that the current near the antenna is decreased. Accordingly, when a receiver (not shown) of the handset device 300 is disposed in a corresponding position to the second side SD32 of the ground plane 310, since the current flowing through the low current area AR32 increases, interference to the receiver by the electric field is effectively decreased.

More specifically, the absorber 350 is disposed in a corresponding position to the high current area AR31 of the ground plane 310. In addition, the absorbing strip is a absorbing material with high permeability to change a magnetic field distribution formed within the high current area AR31 and control a change in the magnetic field formed by an increase in a current density in the current area. Regarding a method for decreasing the magnetic field, it is mainly based on transmission properties according to Snell's law. When wave are transmitted in two different material, reflection and refraction phenomena will occur at the interface. In practice, the absorbing strip 350 can be disposed in any position in a housing 410 (preferred in high current density area), as long as the absorbing strip 350 is electrically connected to the ground plane 310 of the system.

A refracted wave has different refraction angles according to properties of the material. When a wave enters a medium with high permeability from a medium with low permeability, the refraction angle is larger than the incident angle. Moreover, when the incident angle is larger than a critical angle, the refracted wave is transmitted along an interface between the two medium and is confined in surfaces of the medium. The surface wave recedes as a traveled distance increases, and transmission of the magnetic field is also restrained at the same moment.

Figure 5:
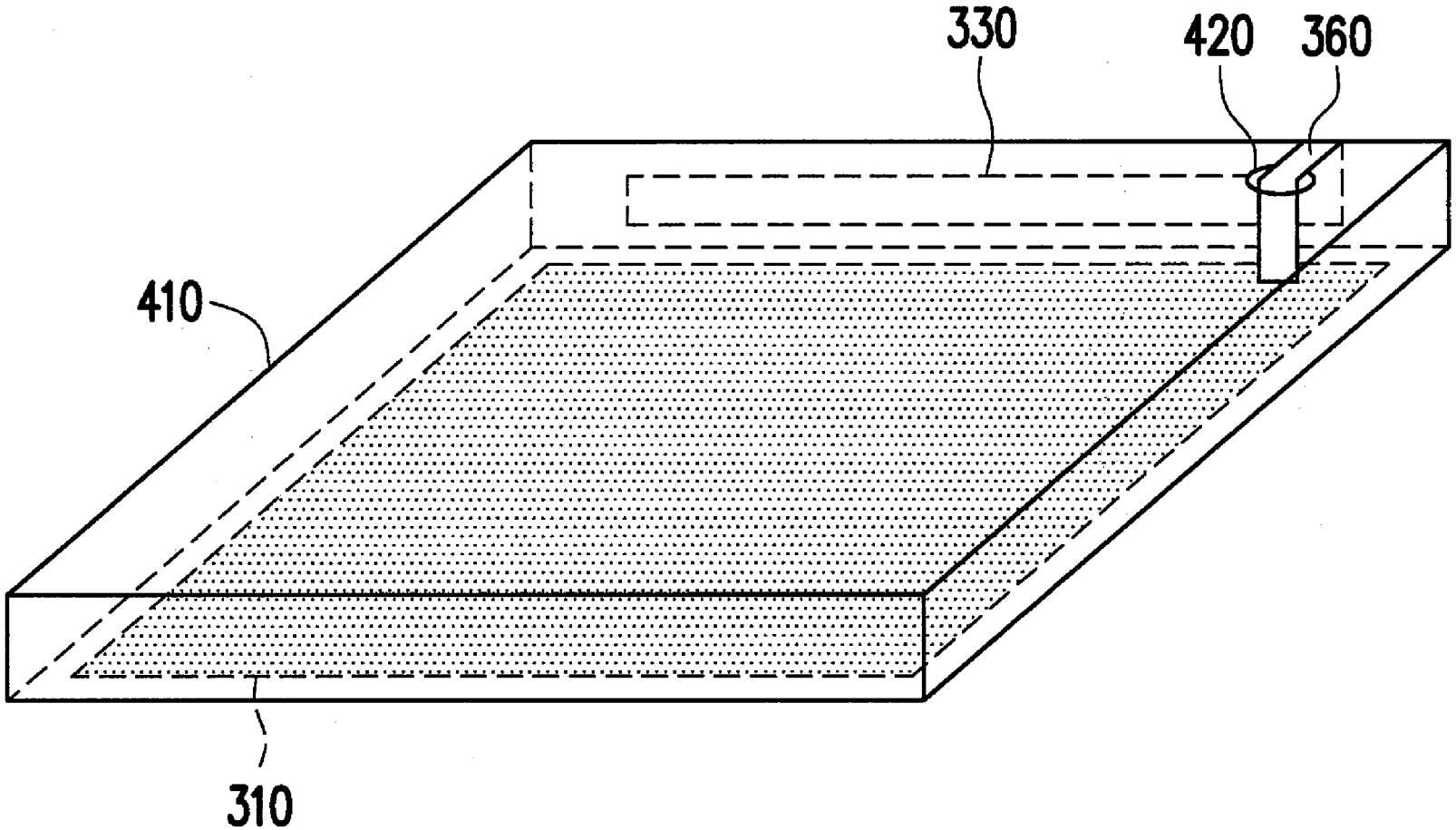
FIG. 5 is a schematic view showing another part of the components of the handset device according to an embodiment of the present invention.

FIG. 5 is a schematic view showing another part of the components of the handset device according to an embodiment of the present invention. Referring to both FIGS. 3 and 5, a detailed structure of the handset device 300 is shown. The handset device 300 further comprises a housing 410 and a through hole 420. The housing 410 is used to accommodate the ground plane 310, the antenna 320, the second conductive strip 340 and the absorbing strip 350. In addition, the first conductive strip 330 is disposed on an outer wall of the housing 410. The through hole 420 is used to penetrate through the housing 410. Therefore, the ground conductor 360 is inserted through the through hole 420 to be electrically connected to the ground plane 310 and the first conductive strip 330.

Figure 6:
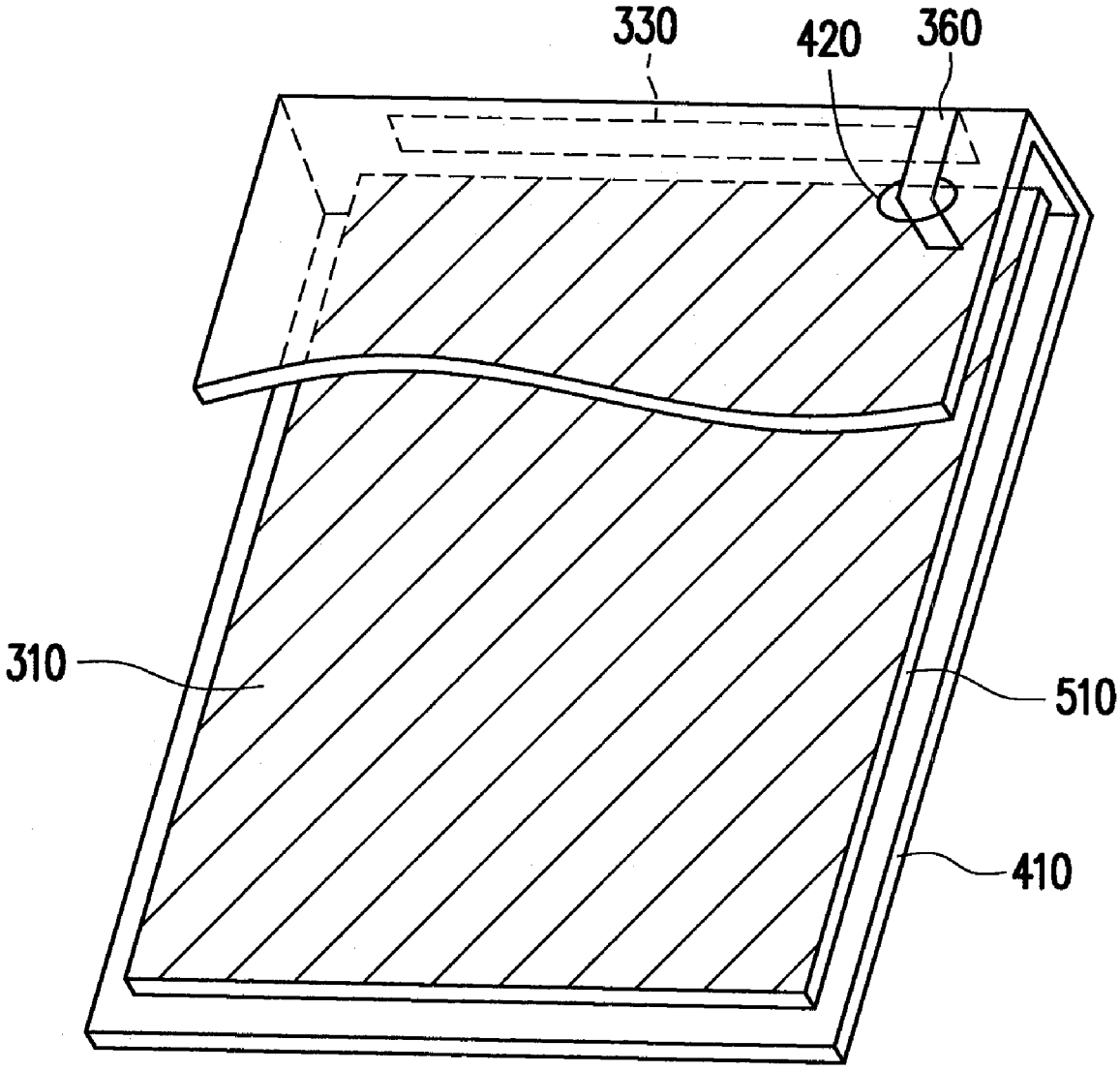
FIG. 6 is a schematic view showing still another part of the components of the handset device according to an embodiment of the present invention.

It should be noted that, according to the embodiment of FIG. 5, the ground plane 310 is disposed on an inner wall of the housing 410. However, referring FIG. 6, the ground plane 310 may also be disposed on a substrate 510, wherein FIG. 6 is a schematic view showing still another part of the components of the handset device according to an embodiment of the application. Referring to both FIGS. 3 and 6, the handset device 300 further comprises a substrate 510, which is, for example, a printed circuit board. According to the embodiment in FIG. 6, the substrate 510 is disposed inside the housing 410. In addition, the ground plane 310 is disposed on a surface of the substrate 510, and the absorbing strip 350 is adhered to the other surface of the substrate, or the ground plane 310 and the absorbing strip 350 are disposed on the same surface of the substrate 510.

In summary, the application uses the first conductive strip and the second conductive strip to change the current distribution on the ground plane, so that effects on a hearing aid by the electric field are decreased. In addition, the application further uses the absorbing strip to restrain the transmission of the magnetic field. Therefore, in a situation of disposing the antenna, the handset device of the application complies with rules of HAC defined by the FCC. In other words, the application not only realizes the simultaneous operation of the handset device and the hearing aid, but also gives consideration to development towards miniaturization and applications.

Although the application has been described with reference to the above embodiments, application of the application is not limited to these embodiments. It will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A handset device, comprising:
a ground plane;
an antenna, electrically connected to the ground plane and forming a current loop with the ground plane, wherein the ground plane forms a current area according to the current loop;
a first conductive strip, electrically connected to the current area, the first conductive strip changing a current distribution on the ground plane to increase a current density passing through the current area; and
a ground conductor, disposed on the ground plane along a first direction perpendicular to the ground plane and curved into an L shape, wherein the first conductive strip is parallel to the first direction and electrically connected to the ground plane through the ground conductor.

2. The handset device of claim 1, further comprising:
a second conductive strip, coupled to the ground plane and the first conductive strip, wherein the first and the second conductive strips change the current distribution on the ground plane to increase the current density passing through the current area.

3. The handset device of claim 2, wherein the ground plane comprises a first side and a second side opposite to each other, and the antenna is disposed along the first side.

4. The handset device of claim 3, wherein the first conductive strip and the second conductive strip are disposed on the second side, and a length of the first conductive strip is not longer than a length of the second side.

5. The handset device of claim 3, wherein the antenna comprises:

a radiating part, disposed along the first side and parallel to the ground plane;

a feeding part, electrically connected to the radiating part and the ground plane; and a short circuit part, electrically connected to a third side adjacent to the first side, wherein the ground plane further comprises the third side, and the short circuit part is electrically connected to the radiating part.

6. The handset device of claim 1, further comprising:

an absorbing strip, electrically connected to the ground plane, the absorbing strip being absorbing material with high permeability to control a change in a magnetic field formed by an increase in the current density of the current area.

7. The handset device of claim 1, wherein the ground conductor is electrically connected the antenna and the ground plane.

8. The handset device of claim 1, further comprising:

a housing; and a through hole, used to penetrate through the housing, wherein the first conductive strip is disposed on an outer wall of the housing, and the ground conductor is inserted through the through hole to be electrically connected to the ground plane and the first conductive strip.

9. The handset device of claim 8, wherein the ground plane is disposed on an inner wall of the housing.

10. The handset device of claim 8, further comprising:

a substrate, disposed inside the housing, wherein the ground plane is disposed on a surface of the substrate, and the absorbing strip is adhered to the other surface of the substrate, or the ground plane and the absorbing strip are disposed on the same surface of the substrate.

11. The handset device of claim 10, wherein the substrate is a printed circuit board.

12. The handset device of claim 1, wherein the handset device is a personal digital assistant phone, a smart phone, a satellite positioning device or a personal digital assistant.

* * * * *